US011709442B2

(12) United States Patent
Koike et al.

(10) Patent No.: US 11,709,442 B2
(45) Date of Patent: Jul. 25, 2023

(54) CONSUMABLE SUPPLY METHOD, CONSUMABLE CONTAINER, IMAGE FORMING APPARATUS, AND REFILL CONSUMABLE CONTAINER

(71) Applicants: Toshio Koike, Tokyo (JP); Daisuke Takahashi, Kanagawa (JP); Akio Kosuge, Kanagawa (JP); Shinichi Akatsu, Kanagawa (JP); Daisuke Ito, Kanagawa (JP); Atsushi Nagata, Kanagawa (JP); Takayuki Isawa, Kanagawa (JP)

(72) Inventors: Toshio Koike, Tokyo (JP); Daisuke Takahashi, Kanagawa (JP); Akio Kosuge, Kanagawa (JP); Shinichi Akatsu, Kanagawa (JP); Daisuke Ito, Kanagawa (JP); Atsushi Nagata, Kanagawa (JP); Takayuki Isawa, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/714,144

(22) Filed: Apr. 6, 2022

(65) Prior Publication Data

US 2022/0326637 A1 Oct. 13, 2022

(30) Foreign Application Priority Data

Apr. 13, 2021 (JP) ..... 2021-067622

(51) Int. Cl.
*G03G 15/08* (2006.01)

(52) U.S. Cl.
CPC ..... *G03G 15/0894* (2013.01); *G03G 15/0879* (2013.01)

(58) Field of Classification Search
CPC ..... G03G 15/0879; G03G 15/0886; G03G 15/0894; G03G 15/0863; G03G 15/0867
See application file for complete search history.

(56) References Cited

U.S. PATENT DOCUMENTS 6,227,638 B1 5/2001 Childers et al.
2002/0085847 A1* 7/2002 Yoshida ..... G03G 15/0865 399/12

(Continued)

FOREIGN PATENT DOCUMENTS

| | | |
|---|---|---|
| JP | 7-333964 | 12/1995 |
| JP | 2003-149929 | 5/2003 |
| JP | 2011-059211 | 3/2011 |

*Primary Examiner* — Jessica L Eley
(74) *Attorney, Agent, or Firm* — Xsensus LLP

(57) ABSTRACT

There is provided a consumable supply method for supplying a refill consumable stored in a refill consumable container to a consumable container installable in an equipment body. The consumable supply method includes removing a refill information storage device storing information on the refill consumable from the refill consumable container; removing an information storage device storing information on a consumable contained in the consumable container, the information being for exchange with the equipment body, from the consumable container; and attaching the refill information storage device removed from the refill consumable container as an information storage device to the consumable container in place of the information storage device removed from the consumable container.

12 Claims, 6 Drawing Sheets

(56) References Cited

U.S. PATENT DOCUMENTS

| | | | | |
|---|---|---|---|---|
| 2007/0146447 | A1* | 6/2007 | Durham | G03G 15/0865 347/86 |
| 2013/0183048 | A1* | 7/2013 | Eom | G03G 15/0863 399/24 |
| 2013/0236197 | A1* | 9/2013 | Yoshida | G03G 15/0868 399/109 |
| 2018/0321615 | A1 | 11/2018 | Suzuki et al. | |
| 2018/0335721 | A1 | 11/2018 | Koike et al. | |
| 2019/0212668 | A1 | 7/2019 | Koike et al. | |
| 2019/0227479 | A1 | 7/2019 | Suzuki et al. | |
| 2021/0018860 | A1 | 1/2021 | Aso et al. | |

* cited by examiner

CONSUMABLE SUPPLY METHOD, CONSUMABLE CONTAINER, IMAGE FORMING APPARATUS, AND REFILL CONSUMABLE CONTAINER

CROSS-REFERENCE TO RELATED APPLICATIONS

This patent application is based on and claims priority pursuant to 35 U.S.C. § 119(a) to Japanese Patent Application No. 2021-067622, filed on Apr. 13, 2021, in the Japan Patent Office, the entire disclosure of which is incorporated by reference herein.

TECHNICAL FIELD

Embodiments of the present disclosure relate to a consumable supply method for supplying a refill consumable such as a developer contained in a refill container to a consumable container, a consumable container such as a developer container, an image forming apparatus including the consumable container, and a refill consumable container such as a refill developer container.

RELATED ART

Conventionally, there have been known techniques for, in an image forming apparatus such as a copier or a printer, supplying a consumable such as refill toner contained in a refill consumable container to a consumable container such as a toner cartridge.

For example, when toner (consumable) contained in a toner cartridge (consumable container) installed in the image forming apparatus body becomes depleted, another replenishing container (refill consumable container) is connected to the empty toner cartridge. Then, the toner cartridge is replenished with the refill toner (consumable) contained in the other replenishing container.

SUMMARY

According to an embodiment of the present disclosure, there is provided a consumable supply method for supplying a refill consumable stored in a refill consumable container to a consumable container installable in an equipment body. The consumable supply method includes removing a refill information storage device storing information on the refill consumable from the refill consumable container; removing an information storage device storing information on a consumable contained in the consumable container, the information being for exchange with the equipment body, from the consumable container; and attaching the refill information storage device removed from the refill consumable container as an information storage device to the consumable container in place of the information storage device removed from the consumable container.

According to another embodiment of the present disclosure, there is provided a consumable container to be installed in an equipment body and to which a refill consumable contained in a refill consumable container is suppliable. The consumable container includes an information storage device and a holder. The information storage device stores information on a consumable contained in the consumable container. The information is for exchange with the equipment body. The holder detachably holds the information storage device. The holder is configured such that a refill information storage device that stores information on the refill consumable and has been removed from the refill consumable container is attachable in place of the information storage device. The information storage device and the refill information storage device are substantially identical in shape. The holder and a refill holder to detachably hold the refill information storage device in the refill consumable container are substantially identical in shape.

According to still another embodiment of the present disclosure, there is provided an image forming apparatus that includes an image forming apparatus body and the above-described consumable container. The image forming apparatus body is the equipment body. The consumable container contains a developer as the consumable. The consumable container is installed in the image forming apparatus body.

According to still yet another embodiment of the present disclosure, there is provided a refill consumable container to contain a refill consumable and supply the refill consumable to a consumable container installed in an equipment body. The refill consumable container includes a refill information storage device and a refill holder. The refill information storage device stores information on the refill consumable. The refill holder detachably holds the refill information storage device. The refill information storage device is attachable to a holder detachably holding an information storage device in the consumable container. The information storage device stores information on a consumable contained in the consumable container. The information is for exchange with the equipment body, in place of the information storage device. The refill information storage device and the information storage device are substantially identical in shape. The refill holder and the holder are substantially identical in shape.

BRIEF DESCRIPTIONS OF THE DRAWINGS

The aforementioned and other aspects, features, and advantages of the present disclosure would be better understood by reference to the following detailed description when considered in connection with the accompanying drawings, wherein.

Figure 1:
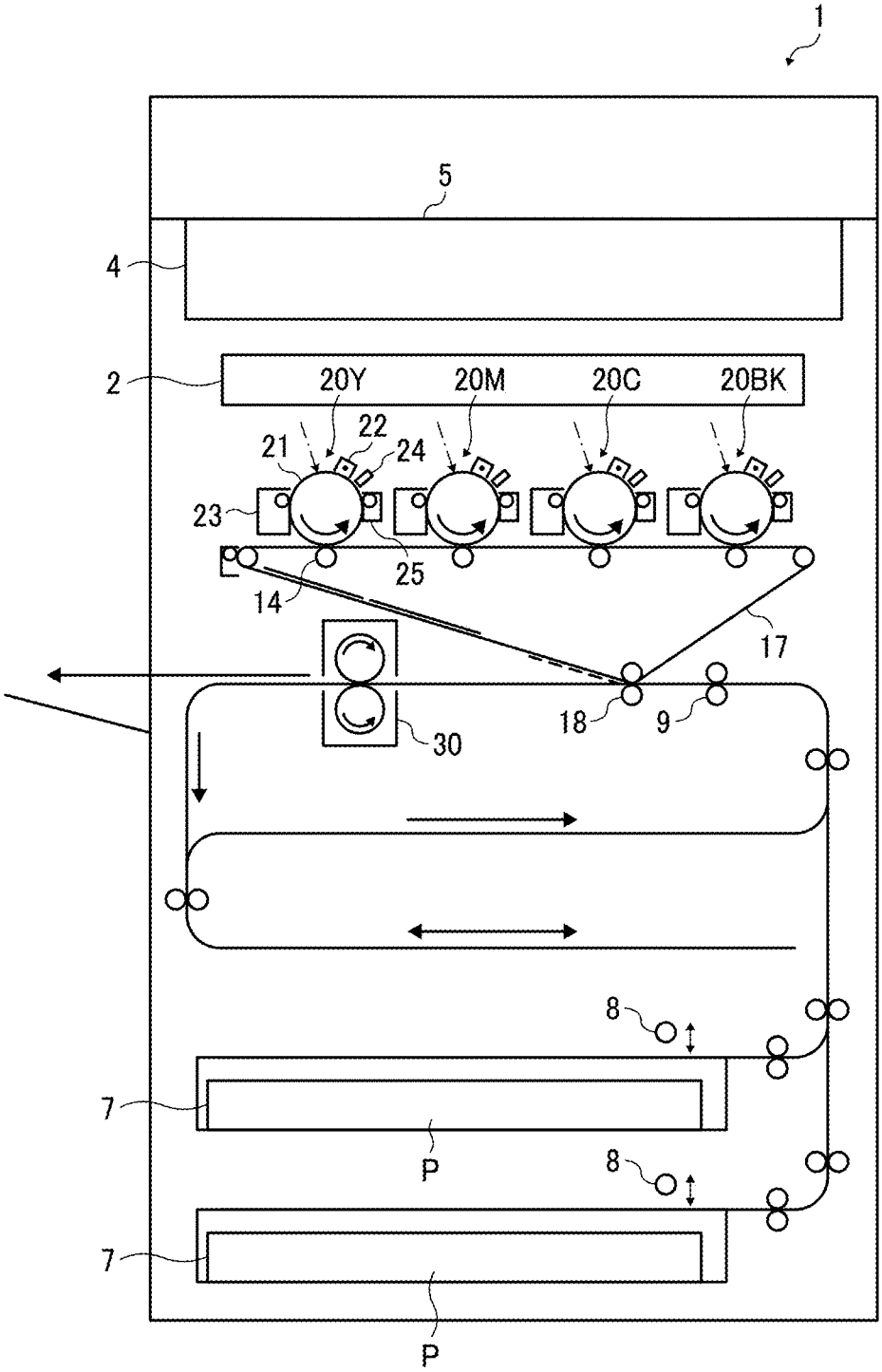
FIG. 1 is a diagram illustrating a general configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Hereinafter, embodiments for carrying out the present disclosure will be described in detail with reference to the drawings. Note that identical reference numerals are assigned to identical or equivalent components and a description of those components may be simplified or omitted.

First, the overall configuration and operations of an image forming apparatus 1 as equipment will be described with reference to FIG. 1.

In FIG. 1, an image forming apparatus (equipment) 1 is a tandem color copying machine, a writing device 2 emits a laser beam based on input image information, a document reader 4 reads image information of a document placed on a contact glass 5, and a sheet feeder 7 contains sheets P such as transfer sheets.

A registration roller pair (timing roller pair) 9 adjusts the conveyance timing of the sheet P, primary transfer bias rollers 14 transfer toner images formed on the surfaces of photoconductor drums 21 onto an intermediate transfer belt 17 in an overlapping manner, the intermediate transfer belt 17 has the toner images of a plurality of colors transferred thereon in an overlapping manner, and a secondary transfer bias roller pair 18 transfers a color toner image on the intermediate transfer belt 17 onto the sheet P.

Process cartridges (image forming devices) 20Y, 20M, 20C, and 20BK correspond to respective colors (yellow, magenta, cyan, and black).

Photoconductor drums 21 are image bearers installed in the process cartridges 20Y, 20M, 20C, and 20BK of the corresponding colors, chargers 22 charge the surfaces of the corresponding photoconductor drums 21, developing devices 23 develop an electrostatic latent image formed on the surfaces of the corresponding photoconductor drums 21, static eliminators 24 eliminate the surface potentials of the corresponding photoconductor drums 21, and cleaners 25 collect untransferred toner left on the surfaces of the corresponding photoconductor drums 21.

A fixing device 30 fixes the toner image (unfixed image) secondarily transferred onto the sheet P.

Figure 2:
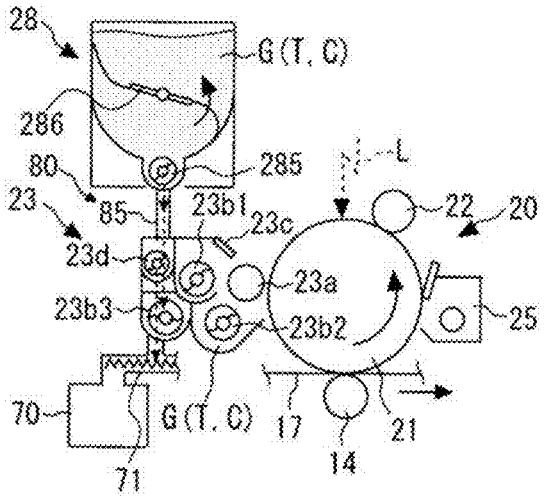
FIG. 2 is a schematic configuration diagram illustrating main parts of an image forming device.

Above each of the process cartridges 20Y, 20C, 20M, and 20BK, installed is a supplier (a developer container 28 as a consumable container and a developer supply device 80) for supplying a developer (a consumable two-component developer containing toner and a carrier) corresponding to the color (yellow, cyan, magenta, or black) to the developing device 23 (see FIG. 2).

A description is provided below of operation of the image forming apparatus 1 to form a normal color image.

FIG. 2 can also be referred to for an image forming process performed in the process cartridges 20Y, 20M, 20C, and 20BK.

First, the document reader 4 optically reads image information of a document placed on the contact glass 5. Specifically, the document reader 4 scans the image of the document on the contact glass 5 with light emitted from an illumination lamp. The light reflected from the surface of the document is imaged on a color sensor via mirrors and lenses. The multicolor image information of the document is read for each color separation light of red, green, and blue (RGB) by the color sensor and converted into electrical image signals. The image processor performs color conversion processing, color correction processing, and spatial frequency correction processing on the basis of the RGB color separation image signals to obtain color image information of yellow, magenta, cyan, and black.

The yellow, magenta, cyan, and black image information items are transmitted to the writing device 2. Then, the writing device 2 emits laser beams L (see FIG. 2) based on the image information of the four colors toward the surfaces of the corresponding photoconductor drums 21.

On the other hand, the four photoconductor drums 21 rotate counterclockwise in FIGS. 1 and 2. First, the surfaces of the photoconductor drums 21 are uniformly charged at portions facing the corresponding chargers 22 (charging step). In this way, charging potentials are formed on the photoconductor drums 21. Subsequently, the surfaces of the photoconductor drums 21 thus charged reach respective positions where the surfaces of the photoconductor drums 21 are irradiated by the laser beams L.

The writing device 2 emits the laser beams L from four light sources corresponding to the four colors in accordance with the image signals. The laser beams pass through optical paths different among color components of yellow, magenta, cyan, and black (exposure step).

The surface of the photoconductor drum 21 of the process cartridge 20Y, first from the left side of the surface of the paper on which FIG. 1 is drawn, is irradiated with the laser beam corresponding to the yellow component. At this time, the photoconductor drum 21 is scanned with the laser beam of the yellow component by a high-speed rotating polygon mirror in the rotation axis direction (main scanning direction, longitudinal direction) of the photoconductor drum 21. In this way, an electrostatic latent image corresponding to the yellow component is formed on the photoconductor drum 21 charged by the charger 22.

Similarly, the surface of the photoconductor drum 21 of the process cartridge 20M, second from the left side of the surface of the paper on which FIG. 1 is drawn, is irradiated with the laser beam corresponding to the magenta component, and an electrostatic latent image corresponding to the magenta component is formed on the surface. The surface of the photoconductor drum 21 of the process cartridge 20C, third from the left side of the surface of the paper on which FIG. 1 is drawn, is irradiated with the laser beam corresponding to the cyan component, and an electrostatic latent image corresponding to the cyan component is formed on the surface. The surface of the photoconductor drum 21 of the process cartridge 20BK, fourth from the left side of the surface of the paper on which FIG. 1 is drawn, is irradiated with the laser beam corresponding to the black component, and an electrostatic latent image corresponding to the black component is formed on the surface.

Then, the surfaces of the photoconductor drums 21 having the electrostatic latent images of the four colors reach respective positions opposite the corresponding developing devices 23. The developing devices 23 supply toner of the four colors onto the surfaces of the corresponding photoconductor drums 21 and develop the electrostatic latent images on the photoconductor drums 21 into toner images (a development process).

Specifically, referring to FIG. 2, a developer G is pumped up by magnetic force of the magnetic pole of a developing roller 23*a* and is adjusted to an appropriate amount by a doctor blade 23*c*, and then is conveyed to a development region facing the photoconductor drum 21. A carrier C (developer G) napped in the development region slides on the photoconductor drum 21. At this time, toner T mixed in the carrier C is negatively charged by friction with the carrier C. On the other hand, the carrier C is positively charged. A predetermined developing bias is applied to the developing roller 23*a* from the power supply. Accordingly, an electric field is formed between the developing roller 23*a* and the photoconductor drum 21, and the negatively charged toner T selectively adheres only to image portions on the photoconductor drum 21 due to the electric field to form a toner image. The developer G moves along the rotation of the developing roller 23*a*, and the developer G after the development step is separated from the developing roller 23*a* and returned to the developing device 23 (second conveyance path B2).

Thereafter, the surfaces of the photoconductor drums 21 after the development process reach respective portions facing the intermediate transfer belt 17. Here, the primary transfer bias rollers 14 are placed on the facing portions so as to abut against the inner peripheral surface of the intermediate transfer belt 17. Then, at the primary transfer bias rollers 14, the toner images of the respective colors formed on the photoconductor drums 21 are sequentially superimposed and transferred onto the intermediate transfer belt 17 (primary transfer step).

Then, the surfaces of the photoconductor drums 21 after the primary transfer step reach respective positions facing the corresponding cleaners 25. The untransferred toner left on the photoconductor drums 21 is collected by the cleaners 25 (cleaning step).

Thereafter, the surfaces of the photoconductor drums 21 pass through the corresponding static eliminators 24, and a series of steps of image formation process on the photoconductor drums 21 is ended.

On the other hand, the intermediate transfer belt 17 on which the toner of the four colors is transferred (carried) from the photoconductor drums 21 in an overlapping manner, travels in a clockwise direction in the drawing and reaches a position facing the secondary transfer bias roller pair 18. Then, the color toner image borne on the intermediate transfer belt 17 is transferred onto the sheet P at the position facing the secondary transfer bias roller pair 18 (secondary transfer step).

Thereafter, the surface of the intermediate transfer belt 17 reaches the position of the intermediate transfer belt cleaner. Then, the untransferred toner adhering to the intermediate transfer belt 17 is collected by the intermediate transfer belt cleaner, and a series of steps of transfer process in the intermediate transfer belt 17 is ended.

The sheet P conveyed between the intermediate transfer belt 17 and the secondary transfer bias roller pair 18 (which is a secondary transfer nip) is conveyed from the sheet feeder 7 via the registration roller pair 9 and the like.

Specifically, the sheet P fed by the feed roller 8 from the sheet feeder 7 that stores the sheet P is conveyed to the conveyance roller and guided to the registration roller pair 9. When reaching the registration roller pair 9, the sheet P is conveyed toward the secondary transfer nip at an adjusted timing.

Then, the sheet P to which the full-color image has been transferred is guided to the fixing device 30 by the conveyance belt. In the fixing device 30, the toner image (color image) on the sheet P is heated and melted at a nip between a fixing roller (in which a heater as a heat source is provided) and a pressure roller, and is fixed on the sheet P.

Then, the sheet P after the fixing process is output as a sheet with an output image by an output roller pair to the outside of the image forming apparatus 1, and a series of steps of image forming process is ended.

Next, the process cartridge 20 (image forming device), the developer container 28 (consumable container), and the developer supply device 80 in the image forming apparatus will be described with reference to FIGS. 2 to 5 and the like.

Figure 3:
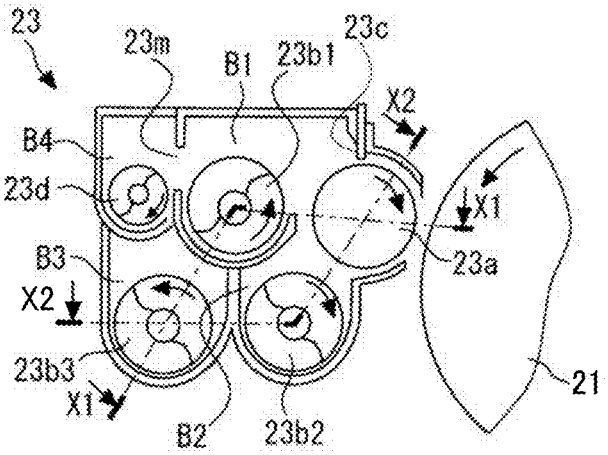
FIG. 3 is an enlarged view of a developing device.

The process cartridges 20Y, 20C, 20M, and 20BK have substantially the same structure, and the developer containers 28 (28Y, 28C, 28M, 28BK) and the developer supply devices 80 (80Y, 80C, 80M, 80BK) also have substantially the same structure, and thus the process cartridge, the developer container, and the developer supply device are illustrated in FIGS. 2 to 4 without alphabets of reference signs reference (Y, C, M, and BK).

As illustrated in FIG. 2, the process cartridge 20 is formed by integrating the photoconductor drum 21 as an image bearer, the charger 22, the developing device 23, and the cleaner 25. A premix developing method (a developing method by which to appropriately supply and discharge carriers) is adopted in the process cartridge 20.

The photoconductor drum 21 as an image bearer is a negatively charged organic photoconductor, and is rotationally driven in a counterclockwise direction by a rotation drive mechanism.

The charger 22 is an elastic charging roller in which a medium-resistance foamed urethane layer containing a urethane resin, carbon black as conductive particles, a sulfuration agent, a foaming agent, and the like is formed in a roller shape on a core metal. As a material of the medium-resistance layer of the charger 22, a rubber material in which a conductive substance such as carbon black or a metal oxide is dispersed in urethane, ethylene-propylene-diene polyethylene (EPDM), butadiene acrylonitrile rubber (NBR), silicone rubber, isoprene rubber, or the like for resistance adjustment, or a material obtained by foaming these rubber materials can also be used. In the present embodiment, the charging roller is used as the charger 22, but a corona discharge-type wire charger can also be used as the charger 22.

The cleaner 25 is provided with a cleaning blade that is to be pressed against the photoconductor drum 21, thereby to mechanically remove and collect untransferred toner on the photoconductor drum 21. The untransferred toner collected inside the cleaner 25 is conveyed to the outside of the cleaner 25 by a conveyance coil, and is collected as waste toner inside a collection container 70 via a conveyance pipe 71.

In the developing device 23, the developing roller 23*a* as a developer bearer is arranged close to the photoconductor drum 21 with an opening (formed in a developing case) in between, and a development region where the photoconductor drum 21 and a magnetic brush contact with each other is formed in a part where the developing roller 23*a* and the photoconductor drum 21 face each other. In the developing device 23, the developer G including the toner T and carrier C (a two-component developer also including additives and the like) is stored. The developing device 23 develops the electrostatic latent image formed on the photoconductor drum 21 (forms a toner image).

The developing device 23 according to the present embodiment is of a premix developing system. A new developer G (toner T and carrier C) is appropriately supplied from the developer container 28 to the inside of the developing device 23 via the developer supply device 80. The deteriorated developer G (mainly carrier C) is discharged from the outlet to the outside of the developing device 23, and is collected as a waste developer in the collection container 70 (where the waste toner described above is also collected) via the conveyance pipe 71.

Referring to FIG. 2, the developer container 28 as a consumable container contains therein the developer G (toner T and carrier C) to be supplied into the developing device 23. Then, the developer container 28 functions to supply the new toner T to the developing device 23 and functions to supply the new carrier C to the developing device 23. Specifically, a conveying screw 285 of the developer supply device 80 is rotationally driven on the basis of the information of toner density (which is the proportion of the toner in the developer G) detected by a magnetic sensor (installed in the third conveyance path B3) installed in the developing device 23, the developer G in the developer container 28 is conveyed toward a drop path portion 85, and the developer G is dropped and supplied by its own weight from the drop path portion 85 toward the inside of the developing device 23.

Referring to FIG. 2, the developer container 28 in the present embodiment is a substantially box-shaped container, and is provided with the conveying screw 285, a stirrer 286, a shutter (not illustrated) that opens and closes an opening for discharge, and the like.

Figure 8A:
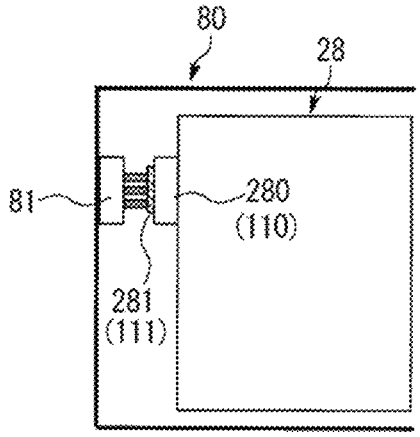
FIG. 8A is a diagram illustrating a developer container that is attached to the image forming apparatus body.
Figure 8B:
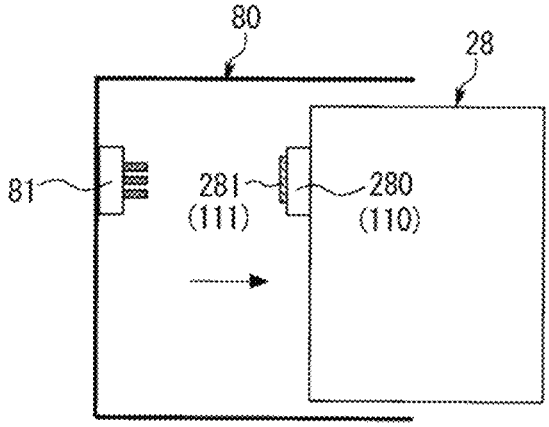
FIG. 8B is a diagram illustrating the developer container that is removed from the image forming apparatus body.

The developer container 28 as a consumable container is attached to and detached from the developer supply device 80 (the image forming apparatus body 1) by manual operation of a user in a substantially horizontal direction as an attachment/detachment direction (see FIGS. 8A and 8B).

The stirrer 286 is provided in the developer container 28 to stir the developer G as a consumable contained therein. The stirrer 286 has a flexible sheet-like blade member on a substantially plate-like rigid body, and rotates in a counter-clockwise direction in FIG. 2 around a rotation axis to stir the developer G.

In addition, the developer container 28 has the conveying screw 285 that conveys the developer G stirred by the stirrer 286 in a direction perpendicular to the surface of the paper on which FIG. 2 is drawn. The conveying screw 285 has a screw part formed on a rotation shaft. Then, the developer G conveyed by the conveying screw 285 is discharged to the outside of the container from a discharge opening formed on the downstream side of the conveying direction, and is supplied into the developing device 23 via the drop path portion 85 of the developer supply device 80.

Although not illustrated, the developer container 28 is provided with a shutter that opens and closes the discharge opening in conjunction with attachment/detachment operation to/from the developer supply device 80 (image forming apparatus body 1).

Figure 5:
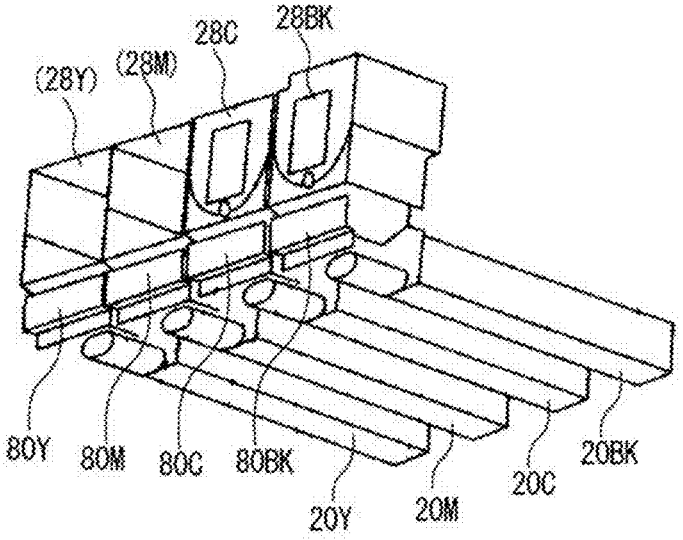
FIG. 5 is a perspective view of developer containers that are installed in the image forming apparatus body.

As illustrated in FIG. 5, the developer container 28 (28Y, 28C, 28M, 28BK) and the developer supply device 80 (80Y, 80C, 80M, 80BK) configured as described above are provided for the four colors corresponding to the process cartridges 20Y, 20C, 20M, and 20BK for the four colors, respectively.

FIG. 5 illustrates a state in which the yellow developer container 28Y and the magenta developer container 28M are not installed in the respective developer supply devices 80Y and 80M, and the cyan developer container 28C and the black developer container 28BK are installed in the respective developer supply devices 80C and 80BK.

In addition, the developer container 28 (consumable container) in the present embodiment is configured such that when the developer G (consumable) stored therein becomes depleted (or a state close thereto), the refill developer G (consumable) can be replenished from the refill developer container 100 (see FIGS. 6 and 7) serving as the refill consumable container, which will be described later in detail.

Hereinafter, the configuration and operations of the developing device 23 will be described in more detail.

Referring to FIGS. 3 and 4, the developing device 23 includes the developing roller 23*a* (developer bearer), three conveying screws 23*b*1 to 23*b*3 (conveying member), a doctor blade 23*c* (developer regulator), a discharge conveying screw 23*d* (discharge conveying member), and the like. In addition, in the developing device 23, three conveyance paths B1 to B3 for conveying the developer G to form a circulation path are formed, and a discharge path B4 for appropriately discharging the excess developer G to the outside of the developing device 23 is further formed.

The developing roller 23*a* is configured such that a sleeve 23*a*2 obtained by forming a non-magnetic material such as aluminum, brass, stainless steel, or conductive resin into a cylindrical shape is rotated in a clockwise direction in FIGS. 2 and 3 by a rotation drive mechanism. In the sleeve 23*a*2 of the developing roller 23*a*, a magnet 23*al* that forms a magnetic field so as to generate napping of the developer G is fixed on the peripheral surface of the sleeve 23*a*2. The carrier C in the developer G is napped in a chain shape on the sleeve 23*a*2 along magnetic lines of force emitted from the magnet 23*a*1 in the normal direction. The toner T adheres to the carrier C napping in the chain shape, thereby forming a magnetic brush. The magnetic brush is transferred in the same direction (clockwise direction) as the sleeve 23*a*2 by the rotation of the sleeve 23*a*2.

The doctor blade 23*c* is placed on the upstream side of the developing region to regulate the developer on the developing roller 23*a* to an appropriate amount.

In each of the conveying screws 23*b*1 to 23*b*3 as the three conveying members, a screw portion is wound around a shaft portion in a spiral shape. The conveying screws 23*bi* to 23*b*3 stir and mix the developer G stored in the developing device 23 is stirred and mixed while circulating in the longitudinal direction (a direction perpendicular to the surface of the paper on which FIG. 3 is drawn, a lateral direction of FIGS. 4A and 4B, and a direction aligned with the rotation axis direction of the developing roller 23*a*).

The first conveying screw 23*b*1 as a first conveying member is disposed so as to face the developing roller 23*a*, and supplies the developer G to the developing roller 23*a*. The second conveying screw 23*b*2 as a second conveying member is disposed at a position below the first conveying screw 23*bi* and facing the developing roller 23*a*, and conveys the developer G separated from the developing roller 23*a* (the developer G after the developing step). The third conveying screw 23*b*3 as a third conveying member conveys the developer G having been conveyed by the second conveying screw 23*b*2 and flown in via a relay portion (third relay portion 23*h*) to the upstream side of the first conveyance path B1 (conveyance path formed by the first conveying member).

In the present embodiment, the first conveying screw 23*b*1 (first conveyance path B1), the second conveying screw 23*b*2 (second conveyance path B2), the third conveying screw 23*b*3 (third conveyance path B3), and the discharge conveying screw 23*d* (discharge conveying member) to be described later are installed so that the rotation axis direction thereof is parallel to the horizontal direction, similarly to the developing roller 23*a*.

The three conveying screws 23*b*1 to 23*b*3, together with the developing roller 23*a* and the discharge conveying screw 23*d* to be described later, are rotationally driven in rotation directions indicated by arrows in FIG. 3 by transmission of driving force via a gear train from a rotational driving mechanism that rotationally drives the developing roller 23*a*.

More specifically, the conveyance path (first conveyance path B1) formed by the first conveying screw 23*b*1 (first conveying member), the conveyance path (second conveyance path B2) formed by the second conveying screw 23*b*2 (second conveying member), and the conveyance path (third conveyance path B3) formed by the third conveying screw 23*b*3 (third conveying member) are isolated from one another by wall portions. The downstream side of the third conveyance path B3 and the upstream side of the first conveyance path B1 communicate with each other via a first relay portion 23*f*. The downstream side of the first conveyance path B1 and the upstream side of the third conveyance path B3 communicate with each other via a second relay portion 23*g* (drop path). The downstream side of the second conveyance path B2 and the upstream side of the third conveyance path B3 communicate with each other via the third relay portion 23*h* that serves as a relay portion. The developer G is delivered to the different conveyance paths by the relay portions 23*f*, 23*g*, and 23*h*.

Figure 4A:
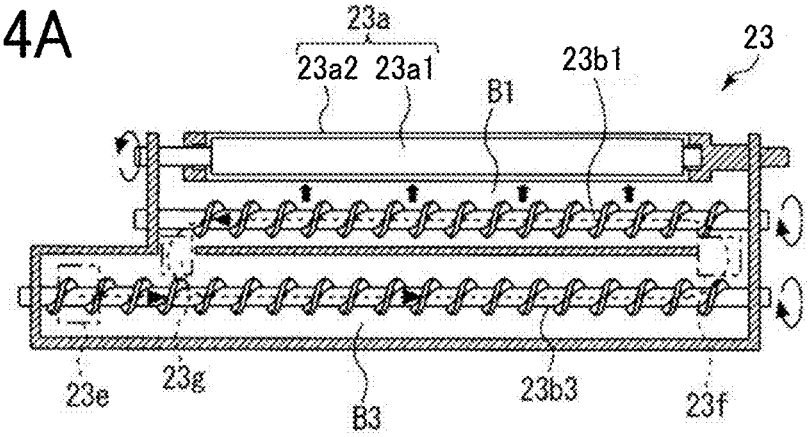
FIG. 4A is a schematic cross-sectional view of an X1 cross section in the developing device illustrated in FIG. 3.
Figure 4B:
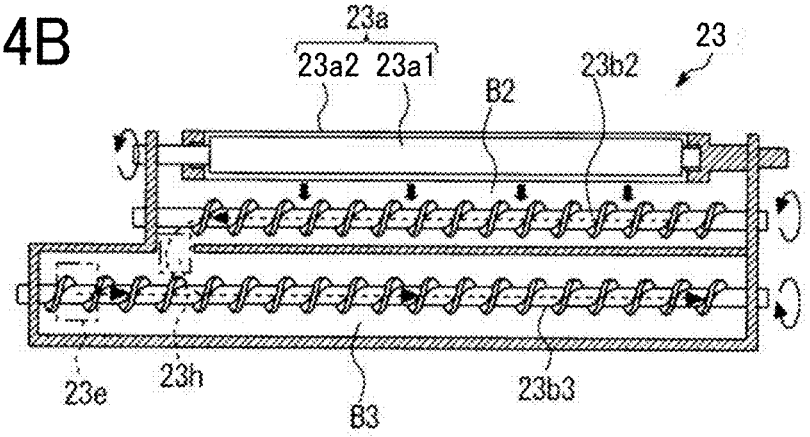
FIG. 4B is a schematic cross-sectional view of an X2 cross section in the developing device illustrated in FIG. 3.

Referring to FIGS. 4A, 4B, 5, and the like, formed above the third conveyance path B3 (ceiling portion) is a supply port 23*e* that communicates with the developer container 28 and the developer supply device 80 functioning as a supplier that newly supplies the carrier C together with the toner T into the developing device 23.

With such a configuration, a circulation path for circulating the developer G in the longitudinal direction in the developing device 23 is formed by the three conveyance paths B1 to B3 (conveying screws 23*b*1 to 23*b*3).

Specifically, referring to FIG. 4A, in the first conveyance path B1, the developer G is supplied to the developing roller 23*a* as indicated by black arrows while being conveyed in the longitudinal direction (horizontal direction) from right to left by the first conveying screw 23*b*1. On the upstream side of the first conveyance path B1, the developer G accumulated and swelling on the downstream side of the third conveyance path B3 is supplied (flown in) via the first relay portion 23*f*. On the downstream side of the first conveyance path B1, the developer G dropped by its own weight to the upstream side of the third conveyance path B3 is supplied (flown) via the second relay portion 23*g*.

Referring to FIG. 4B, in the second conveyance path B2, the developer G separated from the developing roller 23*a* is conveyed by the second conveying screw 23*b*2 in the longitudinal direction (horizontal direction) from right to left as indicated by black arrows. On the downstream side of the second conveyance path B2, the developer G is conveyed (flown out) toward the upstream side of the third conveyance path B3 via the third relay portion 23*h*.

Referring to FIGS. 4A and 4B, on the upstream side of the third conveyance path B3, the developer G is supplied (flows in) from the first conveyance path B1 via the second relay portion 23*g*, and the developer G is supplied (flows in) from the second conveyance path B2 via the third relay portion 23*h*. The developer G flowing in from the second relay portion 23*g* and the third relay portion 23*h* includes the new developer G appropriately supplied from the supply port 23*e*. In the third conveyance path B3, the developer G is conveyed in the longitudinal direction (horizontal direction) from left to right by the third conveying screw 23*b*3, and the developer G is supplied to the first conveyance path B1 via the first relay portion 23*f* on the downstream side thereof.

Referring to FIG. 3, formed in a wall portion of the first conveyance path B1 (which is a wall portion of the conveyance path formed by one conveying member among the plurality of conveying members) is a discharge port 23*m* for discharging the developer G to the discharge path B4 when the surface of the developer G conveyed to the wall portion exceeds a predetermined height.

The discharge path B4 is formed to extend in the longitudinal direction at a position facing the developing roller 23*a* with the first conveyance path B1 in between. In the discharge path B4, the discharge conveying screw 23*d* as a discharge conveying member is installed. The discharge conveying screw 23*d* (discharge conveying member) conveys the developer G having been discharged from the discharge port 23*m* in the longitudinal direction in the discharge path B4, and flows the developer G to the outside of the developing device 23 from an outlet (not illustrated) formed in the discharge path B4 on the downstream side of the conveyance direction. The discharge conveying screw 23*d* (discharge conveying member) is formed by spirally winding a screw portion around a shaft portion, and is installed with the rotation axis direction thereof parallel to the horizontal direction, similarly to the three conveying screws 23*b*1 to 23*b*3.

The excess developer G having been discharged to the discharge path B4 is conveyed by the discharge conveying screw 23*d* in a direction perpendicular to the surface of the paper on which FIG. 3 is drawn, and is discharged to the outside of the developing device 23 from the outlet (not illustrated). Then, the developer G having been discharged from the outlet drops into the drop path, flows into the conveyance pipe 71 (see FIG. 2), is conveyed to the conveyance coil installed in the conveyance pipe 71, and is collected as a waste developer in the collection container 70.

As described above, the carrier C (developer G) contaminated and deteriorated by the base resin of the toner T and external additives is automatically discharged to the outside of the developing device 23, thereby to suppress deterioration of image quality even with a lapse of time.

As described above, in the present embodiment, the developing device 23 of premix developing system is used, so that the deterioration speed of the carrier C in the developing device 23 becomes apparently delayed, and the replacement cycle of the developer G can be extended.

Hereinafter, with reference to FIGS. 6 to 8 and others, detailed description will be provided as to the developer container 28 (consumable container), the refill developer container 100 (refill consumable container), and the method of supplying the developer G (consumable) from the refill developer container 100 to the developer container 28 (consumable supply method), which are characteristic in the present embodiment.

As described above with reference to FIG. 2 and others, the developer container 28 functions as a consumable container that can be installed in the image forming apparatus body 1 as an equipment body. Specifically, in the present embodiment, the developer container 28 (consumable container) is detachable from the developer supply device 80 (image forming apparatus body 1). Then, the developer container 28 is removed in an arrow direction from the developer supply device 80 as illustrated in FIG. 8B from the state of being attached to the developer supply device 80 as illustrated in FIG. 8A, or is pushed in the opposite direction of the arrow and attached to the developer supply device 80 as illustrated in FIG. 8A.

The developer G as a consumable is contained in the developer container 28. The developer G (consumable) is gradually consumed by repeating the developing step (image forming process) described above with reference to FIG. 3 and the like, and eventually becomes depleted (or in a state close thereto, and in an end-of-toner state).

When the developer container 28 is in the end-of-toner state as described above, a normal developing process (image forming process) cannot be performed as it is. Therefore, it is necessary to attach another developer container 28 sufficiently filled with the developer G to the developer supply device 80 (image forming apparatus body 1) instead of the empty developer container 28.

However, as described above with reference to FIG. 2, in the developer container 28 according to the present embodiment includes the stirrer 286 that stirs the developer G (consumable) stored therein, the conveying screw 285 that conveys the developer G (consumable) stored therein, and the like, and are relatively expensive. Therefore, setting a new developer container 28 is set in place of the empty (used) developer container 28 increases a cost burden on the user. In the present embodiment, in order to reduce such a cost burden, the empty developer container 28 is supplied (replenished) with a refill developer G (consumable) from the refill developer container 100 (refill consumable container) having an inexpensive and simple structure in which only the developer G is contained without a stirrer, a conveying screw, or the like. That is, when becoming empty, the developer container 28 is not replaced with another one but is replenished with a new developer G and reused.

Specifically, the developer container 28 is a consumable container (first container) that is installed in the image forming apparatus body 1 as an equipment body and is capable of supplying the refill developer G (consumable) contained in the refill developer container 100 (refill consumable container). In the present embodiment, the housing of the developer container 28 is formed of a highly rigid resin material or the like.

Figure 6A:
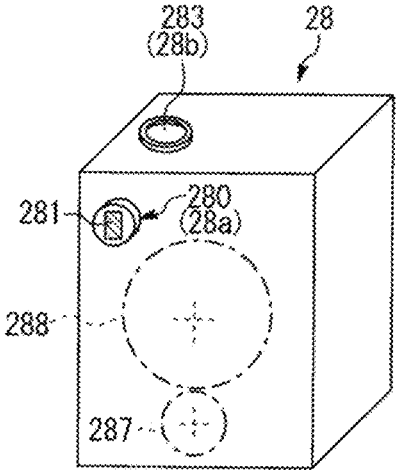
FIG. 6A is a perspective view of a developer container.

As illustrated in FIG. 6A, the developer container 28 (consumable container) is provided with a drive transmission mechanism including gear trains 287 and 288, couplings, and the like for transmitting driving force to the conveying screw 285 and the stirrer 286. FIGS. 7, 8A, and 8B do not illustrate the drive mechanism for simplicity.

As illustrated in FIG. 6A, the developer container 28 has a supply port 28*b* (see FIG. 7) for supplying the developer G from the refill developer container 100. The supply port 28*b* is sealed with a cap 283 (sealing member) to prevent leakage of the developer G except when the developer G is supplied.

In addition, as illustrated in FIG. 6A, the developer container 28 (consumable container) is provided with an information storage device 280 that stores information regarding the developer G (consumable) stored therein, the information being to be exchanged with the image forming apparatus body 1 (equipment body). In the present embodiment, the information storage device 280 mainly includes an ID chip 281 that functions as a main part of the information storage device, and a substantially cylindrical case that holds the identification (ID) chip 281 in an exposed state.

Specifically, referring to FIG. 8A, when the developer container 28 is attached to the image forming apparatus body 1 (developer supply device 80), the ID chip 281 (information storage device 280) in the developer container 28 is connected to a body-side terminal 81 of the image forming apparatus body 1 in conjunction with the attachment operation. This enables exchange of information between the ID chip 281 and the controller of the image forming apparatus body 1. On the basis of the information acquired from the ID chip 281, the controller adjusts (process control) the image forming conditions in the image forming device, displays the amount of the developer remaining in the developer container 28 (the amount of the remaining developer) on an operation display panel (installed in the exterior portion of the image forming apparatus body 1), determines the timing of supplying the developer from the developer container 28 to the developing device 23, or executes the recovery operation from the end-of-toner state.

When the developer container 28 is detached (taken out) from the image forming apparatus body 1 (the developer supply device 80), the ID chip 281 (the information storage device 280) and the body-side terminal 81 are disconnected from each other in conjunction with the detachment operation.

The information stored in advance in the ID chip 281 (information storage device 280) includes information such as the date of manufacture, production lot number, color, type, amount, expiration date, and composition of the developer G (toner T and carrier C) contained in the developer container 28, and the date of manufacture, destination, manufacturing factory, presence or absence of recycling of the developer container 28. The information is sent to the controller of the image forming apparatus body 1 via the body-side terminal 81 (see FIG. 8A). If necessary, information such as a use history of the image forming apparatus body 1 may be sent to the ID chip 281 from the controller of the image forming apparatus body 1 so that the information can be appropriately stored in the ID chip 281.

Figure 7:
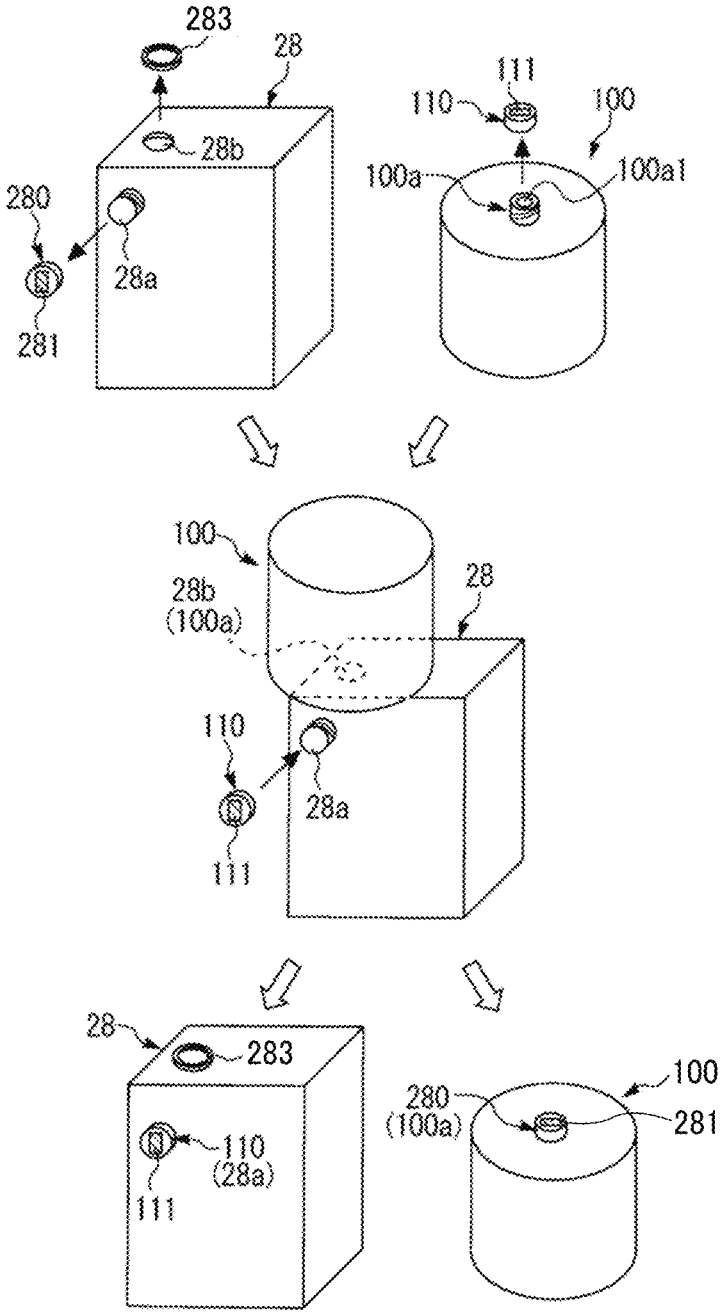
FIG. 7 is a diagram illustrating an operation of supplying a refill developer from the refill developer container to the developer container.

As illustrated in FIGS. 6A and 7, the developer container 28 (consumables container) is provided with a holder 28*a* that detachably holds the information storage device 280.

Specifically, the holder 28*a* is formed in a substantially columnar shape so as to protrude from the side surface of the developer container 28, and has a male screw portion formed on the outer peripheral surface thereof. On the other hand, a female screw portion to engage with the male screw portion of the holder 28*a* is formed in a substantially cylindrical case formed in the information storage device 280. With such a configuration, the information storage device 280 is held by the holder 28*a* through screw engagement, and the information storage device 280 is removed from the holder 28*a* through screw disengagement.

In order to prevent variations in the posture of the information storage device 280 in the rotation direction (screwing direction) held by the holder 28*a* through screw engagement, it is preferable to provide a stopper that determines the posture of the information storage device 280 at the holder 28*a* in the rotation direction.

On the other hand, the refill developer container 100 is a refill consumable container (second container) that can supply the refill developer G (consumable) contained therein to the developer container 28 (consumable container) installed in the image forming apparatus body 1 as the equipment body. In the present exemplary embodiment, the refill developer container 100 can be formed into a bottle shape from a resin material, a glass material, a metal material, a paper material, or the like having high rigidity. Otherwise, the refill developer container 100 does not need to have so high rigidity as compared with the developer container 28, and thus can be formed into a bag shape from polyethylene (PE), polypropylene (PP), polyvinyl chloride (PVC), polyethylene terephthalate (PET), polystyrene (PS), or the like.

Figure 6B:
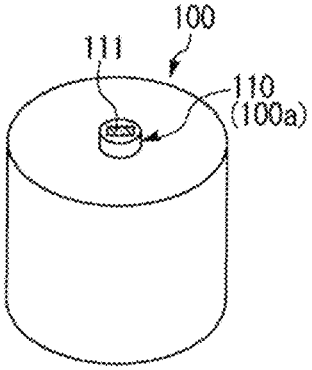
FIG. 6B is a perspective view of a refill developer container.

As illustrated in FIG. 6B, the refill developer container 100 (refill consumable container) has a discharge port 100*al* (see FIG. 7) for discharging the refill developer G (consumable) contained therein and supplying the refill developer G to the developer container 28. The discharge port 100*al* is sealed with a refill information storage device 110 that functions as a cap to prevent leakage of the developer G except when the developer G is supplied.

As illustrated in FIG. 6B, the refill developer container 100 (refill consumable container) is provided with a refill information storage device 110 that stores information on the refill developer G (consumable) contained therein. This information is to be exchanged with the image forming apparatus body 1 (equipment body) when the refill developer G is supplied from the refill developer container 100 to the developer container 28.

In the present exemplary embodiment, the refill information storage device 110 mainly includes an ID chip 111 that functions as a main part of the refill information storage device, and a substantially cylindrical case that holds ID chip 111 in an exposed state.

As illustrated in FIGS. 6B and 7, the refill developer container 100 (refill consumable container) is provided with a refill holder 100*a* that detachably holds the refill information storage device 110.

Specifically, the refill holder 100*a* is formed in a substantially cylindrical shape (with the discharge port 100*a*) so as to protrude from the ceiling surface of the refill developer container 100, and has a male screw portion formed on the outer peripheral surface thereof. On the other hand, a female screw portion to engage with the male screw portion of the refill holder 10*a* is formed in a substantially cylindrical case formed in the refill information storage device 110. With such a configuration, the refill information storage device 110 is held by the refill holder 100*a* through screw engagement, and the refill information storage device 110 is removed from the refill holder 100*a* through screw disengagement.

According to the present exemplary embodiment, the discharge port 100*al* is formed in the refill holder 100*a*. Accordingly, the discharge port 100*al* is opened and closed in conjunction with attachment and detachment of the refill information storage device 110 to and from the refill holder 100*a*.

Specifically, when the refill information storage device 110 is attached to the refill holder 100*a* through screw engagement, the discharge port 100*al* is sealed (closed) by the refill information storage device 110 to prevent leakage of the developer G from the refill developer container 100. On the other hand, when the developer G is discharged from the refill developer container 100, the refill information storage device 110 is removed from the refill holder 100*a* through screw disengagement to open the discharge port 100*a*1.

By providing the discharge port 100*al* in the refill holder 100*a* as described above, the refill developer container 100 can be made compact as compared with the case where the discharge port 100*al* is provided separately from the refill holder 100*a*.

The information storage device 280 and the refill information storage device 110 have substantially the same shape. The holder 28*a* and the refill holder 100*a* (a portion other than the discharge port 100*a* 1 and functioning as a holder) have substantially the same shape.

Therefore, the holder 28*a* is configured such that the refill information storage device 110 that stores information on the refill developer G (consumable) and is removed from the refill developer container 100 can be attached to the holder 28*a*, in place of the information storage device 280.

Similarly, the refill holder 100*a* is configured such that the information storage device 280 can be attached to the refill holder 100*a*, in place of the refill information storage device 110.

That is, the information storage device 280 installed in the holder 28*a* of the developer container 28 in the image forming apparatus body 1 and the refill information storage device 110 installed in the refill holder 100*a* of the refill developer container 100 can be alternately replaced. As illustrated in FIG. 7, when the developer container 28 is refilled with the developer G from the refill developer container 100, the information storage device 280 is removed from the developer container 28, and the refill information storage device 110 is installed in the developer container 28 instead.

Referring to FIG. 8A, when the developer container 28 in which the refill information storage device 110 is installed is attached to the image forming apparatus body 1 (developer supply device 80), the ID chip 111 of the refill information storage device 110 is connected to the body-side terminal 81 of the image forming apparatus body 1 in conjunction with the attachment operation. This enables exchange of information between the ID chip 111 and the controller of the image forming apparatus body 1. On the basis of the information acquired from the ID chip 111, the controller adjusts (process control) the image forming conditions in the image forming device, displays the amount of the developer remaining in the developer container 28 (the amount of the remaining developer) on an operation display panel (installed in the exterior portion of the image forming apparatus body 1), determines the timing of supplying the developer from the developer container 28 to the developing device 23, or executes the recovery operation from the end-of-toner state.

The information stored in advance in the refill information storage device 110 (ID chip 111) includes information such as the date of manufacture, production lot number, color, type, amount, expiration date, and composition of the developer G (the developer G contained in the refill developer container 100) newly supplied to the developer container 28, and information such as the date of manufacture, destination, manufacturing factory, and presence or absence of recycling of the refill developer container 100. The information is sent to the controller of the image forming apparatus body 1 via the body-side terminal 81 (see FIG. 8A). If necessary, information such as a use history of the image forming apparatus body 1 may be sent to the ID chip 111 from the controller of the image forming apparatus body 1 so that the information can be appropriately stored in the ID chip 111.

On the other hand, as illustrated in FIG. 7, when the developer container 28 is refilled with the developer G from the refill developer container 100, the information storage device 280 is removed from the developer container 28 and installed in the refill developer container 100 in place of the refill information storage device 110 removed from the refill developer container 100.

In this way, when the empty refill developer container 100 is recycled, the information storage device 280 can also be recycled.

Hereinafter, with reference to FIG. 7, a consumable supply method for supplying the refill developer G (consumable) contained in the refill developer container 100 (refill consumable container) to the developer container 28 (consumable container) installable in the image forming apparatus body 1 (equipment body) will be collectively described.

First, when the developer container 28 attached to the image forming apparatus body 1 enters in an end-of-toner state, the developer container 28 is removed from the image forming apparatus body 1.

Then, in the removed developer container 28, the cap 283 is removed from the supply port 28*b* and the information storage device 280 is removed from the holder 28*a*. Before and after such an operation, in the refill developer container 100 prepared in advance, the refill information storage device 110 is removed from the refill holder 100*a* to open the discharge port 100*al.*

Thereafter, the discharge port 100*a* 1 of the refill developer container 100 is fitted to the supply port 28*b* of the developer container 28 to supply the developer G in the refill developer container 100 to the developer container 28. Upon completion of the supply, the refill developer container 100 is removed from the supply port 28*b*, and the supply port 28*b* is sealed with the cap 283. Then, the developer container 28 completely refilled with the developer G is attached to the image forming apparatus body 1.

The information storage device 280 is attached to the refill holder 100*a* of the empty refill developer container 100 to seal the discharge port 100*a*1.

As described above, the consumable supply method according to the present embodiment includes:

(1) removing the refill information storage device 110 storing the information on the refill developer G (consumable) from the refill developer container 100 (refill consumable container);

(2) removing the information storage device 280 storing the information on the developer G (consumable) contained in the developer container 28 (consumable container) to be exchanged with the image forming apparatus body 1 (equipment body) from the developer container 28; and (3) attaching the refill information storage device 110 removed from the refill developer container 100 to the developer container 28, as an information storage device, in place of the information storage device 280 removed from the developer container 28.

This allows the image forming apparatus body 1 to recognize the information on the refill developer G supplied from the refill developer container 1N to the developer container 28, so that it is unlikely to cause a defect that the image forming apparatus 1 is operated in a state in which the developer G of a different type such as a different color is erroneously supplied to the developer container 28, a defect that the image forming apparatus body 1 cannot be adjusted in accordance with the characteristics of the supplied refill developer G, and the like.

The consumable supply method according to the present exemplary embodiment includes attaching the information storage device 280 removed from the developer container 28 (consumable container) to the refill developer container 100 (refill consumable container), in place of the refill information storage device 110 removed from the refill developer container 100.

This makes it possible to increase the recycling efficiency of the refill developer container 100 that has become empty after the refilling and the information storage device 280.

The three steps (1) to (3) described earlier including the above-described steps do not indicate the order of performing the steps, and the steps can be performed in any possible order.

As described above, the consumable supply method according to the present embodiment includes: (1) removing the refill information storage device 110 storing the information on the refill developer G (consumable) from the refill developer container 100 (refill consumable container); (2) removing the information storage device 280 storing the information on the developer G (consumable) contained in the developer container 28 (consumable container) to be exchanged with the image forming apparatus body 1 (equipment body) from the developer container 28; and (3) attaching the refill information storage device 110 removed from the refill developer container 100 to the developer container 28, as an information storage device, in place of the information storage device 280 removed from the developer container 28.

This allows the image forming apparatus body 1 (equipment body) to recognize information on the refill developer G (consumable) supplied from the refill developer container 100 (refill consumable container) to the developer container 28 (consumable container).

In the present embodiment, the developer container 28 (consumable container) and the refill developer container 100 (refill consumable container) contain the developer G (two-component developer) as a consumable. However, the consumable container, the refill consumable container, and the consumable supply method according to the embodiments of the present disclosure are not limited thereto, and may be, for example, a consumable container in which a one-component developer (toner), ink, food, machine oil, or the like is stored as a consumable, a refill consumable container in which such a consumable for refilling is stored, and a consumable supply method for supplying such a consumable.

In the present embodiment, the consumable container is the developer container 28. However, the consumable container according to the embodiments of the present disclosure is not limited to the developer container, and may be, for example, a developing device, a process cartridge, an ink cartridge, or another storage container (e.g., bin, mechanical container, or the like).

In the present embodiment, the information storage device 280 and the refill information storage device 110 are held in the holder 28*a* or the refill holder 100*a* by screw engagement. However, a method for holding the information storage device and the refill information storage device is not limited to the above. For example, the information storage device and the refill information storage device can be held in the holder or the refill holder by snap-on pins.

In the present exemplary embodiment, the information storage device 280 and the refill information storage device 110 are configured by the ID chips 281 and 111 and the case. However, the information storage device and the refill information storage device are not limited to this configuration. For example, the information storage device and the refill information storage device can be configured only by ID chips.

In the present exemplary embodiment, the contact-type ID chips 281 and 111 are used as the main parts (information storage media) of the information storage device 280 and refill information storage device 110. However, the main parts (information storage media) of the information storage device and refill information storage device are not limited to thereto, and for example, integrated circuit (IC) chips, IC tags, non-contact radiofrequency identifications (RFIDs), or the like can be used instead.

Note that embodiments of the present disclosure are not limited to the above-described embodiments and it is apparent that the above-described embodiments can be appropriately modified within the scope of the technical idea of the present disclosure in addition to what is suggested in the above-described embodiments. Further, the number, position, shape, and so forth of components are not limited to those of the present embodiment, and may be any number, position, shape, and so forth that are suitable for implementing the present disclosure.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A consumable supply method, comprising:

removing a refill memory storing information of a refill consumable from a refill consumable container;

removing a used memory storing information of a consumable contained in a used consumable container, the information of the consumable being for transmission to an equipment body, from the used consumable container; and attaching the refill memory removed from the refill consumable container to the used consumable container in place of the used memory removed from the used consumable container.

2. The consumable supply method according to claim 1, further comprising attaching the used memory removed from the used consumable container to the refill consumable container in place of the refill memory removed from the refill consumable container.

3. The consumable supply method according to claim 1, wherein the refill memory and the used memory are substantially identical in shape, and wherein a refill holder that detachably holds the refill memory in the refill consumable container and a holder that detachably holds the used memory in the used consumable container are substantially identical in shape.

4. The consumable supply method according to claim 3, wherein:

the refill holder includes a discharge port to discharge the refill consumable contained in the refill consumable container, and the discharge port is opened and closed in conjunction with attachment and detachment of the refill memory to and from the refill holder.

5. The consumable supply method according to claim 1, wherein the equipment body is an image forming apparatus body, and wherein the consumable is a developer.

6. A consumable container for use with an equipment body, the consumable container comprising:

a used memory storing information of a consumable contained in the consumable container; and a holder to detachably hold the used memory, wherein the holder is configured such that a refill memory that stores information of the refill consumable and has been removed from the refill consumable container is attachable in place of the used memory, wherein the used memory and the refill memory are substantially identical in shape, and wherein the holder and a refill holder to detachably hold the refill memory in the refill consumable container are substantially identical in shape.

7. The consumable container according to claim 6, further comprising a stirrer to stir the consumable stored therein.

8. An image forming apparatus, comprising:

an image forming apparatus body that is the equipment body; and the consumable container according to claim 6 containing a developer as the consumable, wherein the consumable container is in the image forming apparatus body.

9. A refill consumable container to contain a refill consumable and supply the refill consumable to a consumable container, the refill consumable container comprising:

a refill memory storing information of the refill consumable; and a refill holder detachably holding the refill memory, wherein the refill memory is attachable to a holder detachably holding a used memory of the consumable container, the used memory storing information of a consumable contained in the consumable container in place of the used memory, wherein the refill memory and the used memory are substantially identical in shape, and wherein the refill holder and the holder are substantially identical in shape.

10. The refill consumable container according to claim 9, wherein:

the refill holder is configured such that the used memory is attachable in place of the refill memory.

11. The refill consumable container according to claim 9, wherein the refill holder includes a discharge port to discharge the refill consumable contained in the refill consumable container, and wherein the discharge port is opened and closed in conjunction with attachment and detachment of the refill memory to and from the refill holder.

12. The refill consumable container according to claim 9, wherein the refill consumable container is in an equipment body which is an image forming apparatus body, and wherein the consumable is a developer.

* * * * *